United States Patent [19]

Labbe

[11] 4,319,589

[45] Mar. 16, 1982

[54] METHOD AND APPARATUS FOR PERFORATING ROD-LIKE ARTICLES

[75] Inventor: Francis A. M. Labbe, Neuilly-sur-Seine, France

[73] Assignee: Molins Limited, London, England

[21] Appl. No.: 26,807

[22] Filed: Apr. 3, 1979

[30] Foreign Application Priority Data

Apr. 7, 1978 [GB] United Kingdom ..... 13690/78

[51] Int. Cl.[3] ..... A24C 5/60

[52] U.S. Cl. ..... 131/281; 83/866; 83/868

[58] Field of Search ..... 131/23, 170 R; 83/868, 83/866

[56] References Cited

U.S. PATENT DOCUMENTS

| | | | |
|---|---|---|---|
| 3,483,873 | 12/1969 | Hinzmann | 131/170 R |
| 3,701,353 | 10/1972 | Pasquine et al. | 131/23 R |
| 3,730,039 | 5/1973 | Fedrigo | 83/170 |
| 4,054,166 | 10/1977 | Ortez, Jr. | 131/170 R |
| 4,061,148 | 12/1977 | Goslin et al. | 131/23 R |
| 4,090,826 | 5/1978 | Hinzmann | 131/23 R |
| 4,148,324 | 4/1979 | Müller | 131/23 R |
| 4,188,847 | 2/1980 | Payne | 131/23 R |

*Primary Examiner*—V. Millin

*Attorney, Agent, or Firm*—Craig and Antonelli

[57] ABSTRACT

A perforating device and a method for perforating double length filter cigarette assemblies, in which cigarettes are transferred from the drying drum, of a plug assembler onto a first conveyor which conveys them into the space between a straight flight of the first conveyor and a parallel flight of a second conveyor. The speed of the first conveyor is varied cyclically relative to that of the second by means of a speed modulator, so that the cigarettes are rolled in successive steps during their travel through the device so as to present successive different segments of the outer circumferential surface of the central filter portion to a perforator device. The perforator is reciprocated parallel to the conveyors in synchronism with the movement of the cigarettes through the device, while also being reciprocated perpendicular to the conveyors so as to perforate the cigarettes at the instant at which their rotational speed is zero, at which point there is therefore no relative rolling between the pins and the cigarettes. After perforation the assemblies are transferred back to the drum of the plug assembler.

19 Claims, 11 Drawing Figures

METHOD AND APPARATUS FOR PERFORATING ROD-LIKE ARTICLES

This invention relates to devices for perforating wrapped rod-like articles such as cigarettes.

It has previously been proposed to perforate the wrappers of cigarettes, particulary filter cigarettes, to provide some degree of dilution of the smoke with fresh air when the smoker inhales. Such perforation can be carried out either before the cigarette is manufactured, i.e. by perforating one or some of the pieces of wrapped paper used in the manufacture, or by perforating the assembly after the filter plug has been attached. The latter method has the advantage that it is a one-step process. However it has been widely assumed until now that the only practical way of perforating assembled cigarettes mechanically is to roll them against the points of sharp pins. It is however very difficult to design a reliable perforator using such a principle, because of the tendency of the pins to wear and even to break off under the repeated bending loads imposed on them, and the conflicting requirement to produce consistent and evenly spaced holes for the sake of controllable dilution and consumer appeal. The pins tend to wear very quickly because usually the cigarettes must be perforated one after another as they issue from the plug assembler, and this means that they are treated in "series", so that all the cigarettes pass over all the perforator pins. This leads to the design of systems having relatively few pins which have to be replaced often.

According to the present invention, on the other hand, there is provided a method of simultaneously perforating a plurality of rod-shaped articles such as cigarettes, comprising arranging a group of articles in a parallel row on a conveyor with their axes at right-angles to the direction of movement of the conveyor, moving a perforating device towards the conveyor carrying the articles so as to perforate them from one side, retracting the perforator device, rotating all the articles of the group simultaneously through a preset angle to present another area to be perforated, actuating the perforator device again, and repeating the process until the desired number of perforations have been provided in each article. Preferably the conveyor is continuously moved past the perforator device, so that a continuous series of such groups of articles can be treated, in which case the perforator is driven in such a way that it moves in synchronism with the conveyor as it is perforating the articles.

The invention also extends to apparatus for simultaneously perforating a plurality of rod-shaped articles, comprising means for transporting a group of articles through a perforating station, and drive means for the transport means and the perforator which is arranged to rotate the articles in successive steps during their movement through the perforating station and to move the perforator towards the articles to perforate them between successive steps of rotation. Preferably the articles are rotated by rolling them between a pair of co-operating transport surfaces, the arrangement being such that rolling only occurs between, and never during, the successive perforation operations, by suitable control of the relative speeds of the transport surfaces.

A preferred form of the apparatus comprises a pair of conveyors arranged with their operative flights in a face-to-face relationship so as to be able to transport the articles between them, drive means for the conveyors which is so arranged that their relative speeds can be cyclically varied, a reciprocating perforator which is mounted adjacent one of the conveyors for movement towards and away from the other conveyor, and drive means for the perforator which is so connected to the conveyor drive means that the perforator movement and the movement of the said other conveyor are synchronised when the perforator is closest to the said other conveyor, that is to say, there is then no relative movement between them in the direction of movement of the conveyors.

Preferably, in the case of filter cigarette manufacture, the apparatus is connected to a plug assembler which connects the filter plugs to the cigarettes, and includes means for feeding the finished cigarettes from the final conveying drum of the plug assembler, into the perforator, and back onto the final drum of the assembler, so that the normal process of conveying and packing is not disrupted.

One embodiment of the invention will now be described by way of example with reference to the accompanying drawings, in which.

Figure 1:
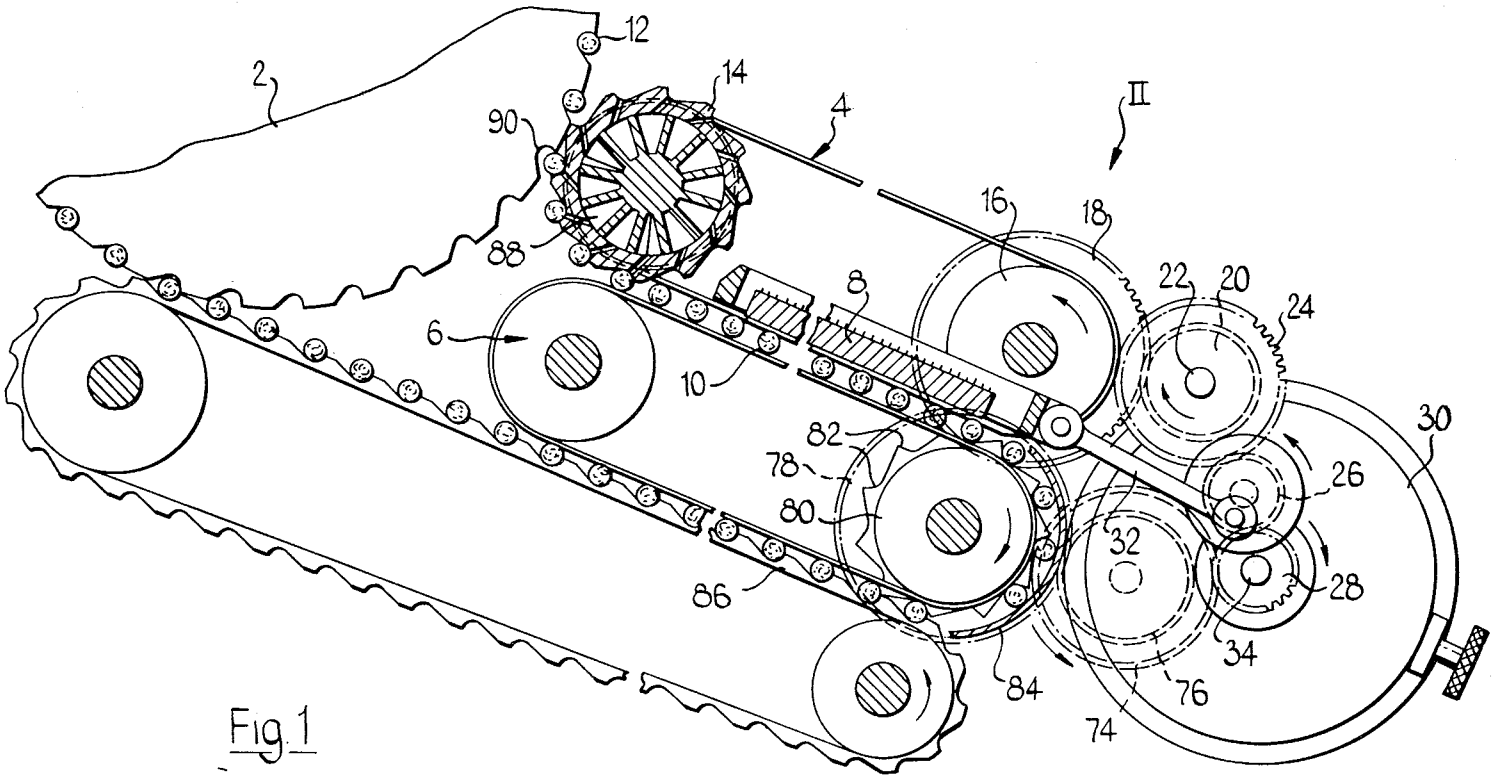
FIG. 1 is a side elevation of a perforator device installed on a plug assembler.

Referring first to FIG. 1, the apparatus is shown in its working relationship with the drying drum 2 of a plug assembler such as the Molins PA8, and comprises basically a first conveyor 4 which is driven at a constant speed, a second conveyor 6 which is driven at a cyclically-varying speed, and a perforator 8 which reciprocates parallel to the conveyors so as to follow the motion of cigarettes 10 carried between the conveyors 4 and 6, and perpendicular to the conveyors so as to perforate the cigarettes, the various parts of the apparatus being driven in a manner which will be described in more detail below.

The detailed construction and operation of the apparatus is as follows: Assembled double length cigarettes 12 which are being transported in a clockwise direction on the drying drum 2, are transferred onto a fluted conveyor pulley 14 by suction which is applied via a chamber behind the pulley, to a stationary sector-shaped chamber 88 inside the pulley. The chamber is of such a size that cigarettes are transferred onto the fluted pulley from the drum 2 at 90, assisted by gravity, and held on the pulley so as to be carried a little over one quarter of a revolution in an anti-clockwise direction, into the nip between conveyor 4, which is trained around pulley 14, and consists of a pair of spaced-apart belts, and conveyor 6 which also consists of a pair of belts.

Figure 2:
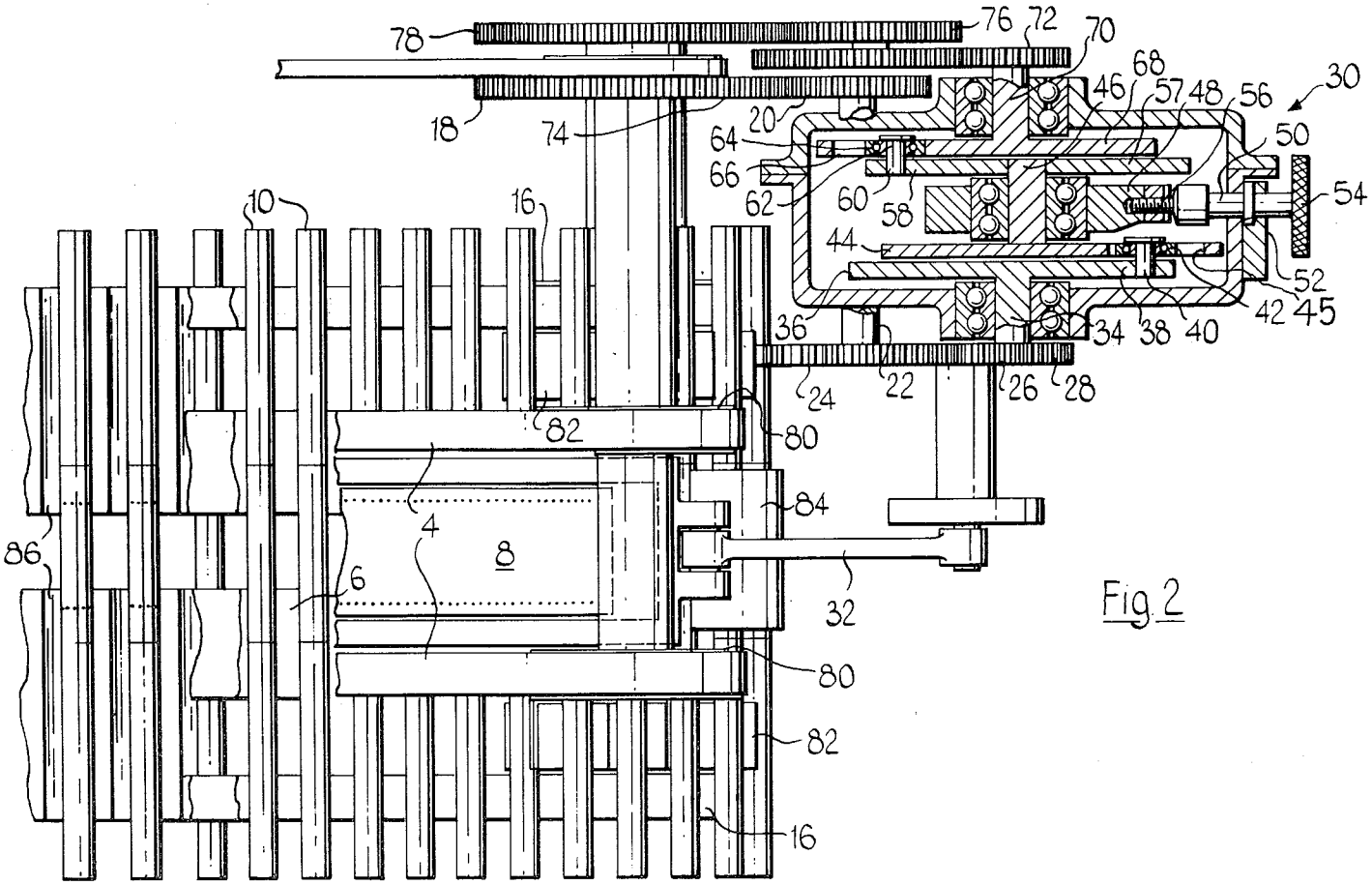
FIG. 2 is a plan view of part of the mechanism of FIG. 1 partly in section.
Figure 3:
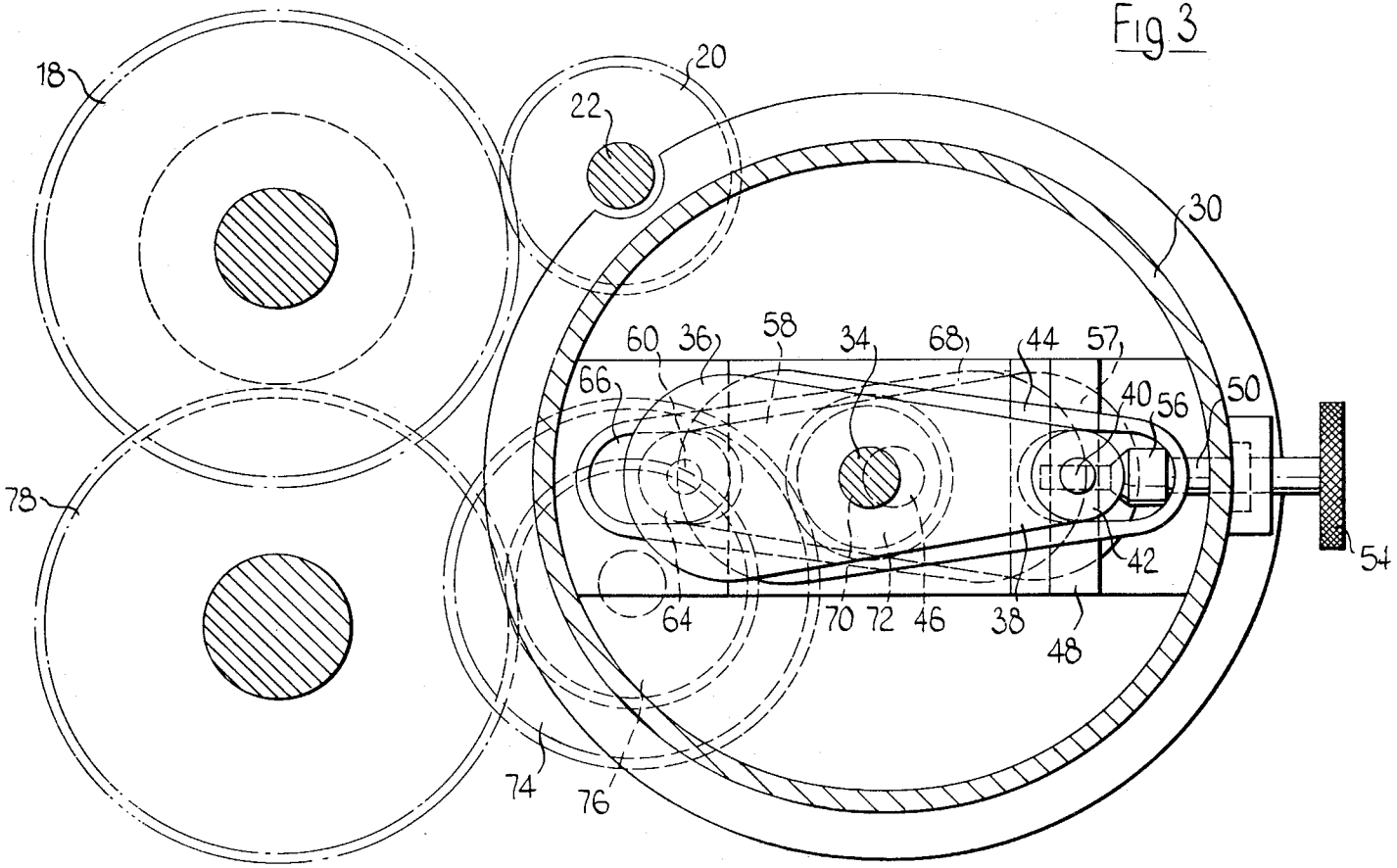
FIG. 3 is a partially sectioned side elevation of part of the apparatus of FIG. 1.

Conveyor 4 is driven by a pulley 16 on a common shaft with a gear 18 which meshes with a gear 20 on a shaft 22 which is connected to the plug assembler drive and rotates at 1/12th of the plug assembler speed. Thus the shaft carrying pulley 16 is driven at a constant speed, which is arranged to be 1/24th machine speed. The shaft 22 also carries gear 24 which drives a gear 26 at 1/6th machine speed, which in turn drives a gear 28 of the same size. The gear 28 drives a "speed modulator" device 30 for conveyor 6, shown in cross-section in FIG. 2, whilst a crank 32 connects the gear 26 directly to the perforator 8, which is positioned between the two belts of conveyor 4, so as to reciprocate it continuously.

The speed modulator 30 comprises a casing in which is journalled a shaft 34 carrying the gear 28. Integral with shaft 34 is a tapered elongate member 36 which carries at its narrower end 38 a fixed shaft 40 having a ball-bearing 42 mounted on it. A co-operating tapered member 44 has a slot 45 to receive the ball race 42 and is mounted behind the member 36, as seen in FIG. 1, on one end of a shaft 46 which is eccentric with the shaft 34 and which is journalled in a carrier 48 (FIG. 2) which is adjustable so that the position of shaft 46 can be varied relative to that of shaft 34. The adjustment mechanism comprises a shaft 50 which is rotatably mounted in a collar 52 in the housing and carries a knurled adjusting knob 54 on its outer end. The inner end 56 has a micrometric thread which mates with a threaded bore in the carrier, and thus rotation of knob 54 causes the carrier 48 to move in the direction of shaft 50, the carrier being located in a track (not shown) in the body of the modulator.

The other end of shaft 46 carries a tapered member 56 which corresponds in shape to member 36 but which is orientated at 180° to member 36. Its narrow end 58 carries a shaft 60 whose outer end 62 in turn carries a ball-race 64 which co-operates with a slot 66 in a member 68 corresponding in shape to member 44, and mounted on a shaft 70 forming the output of the speed modulator device. It will be noted that speed modulation is carried out in two stages with the adjustment mechanism between them. This enables variation of the degree of modulation to be achieved without altering the position of the output shaft 70.

In operation the input to the speed modulator device on shaft 34 is transmitted to member 44 in ball-race 42 co-acting with slot 45, and because of the eccentric mounting of shaft 46, the transmission ratio varies cyclically over each revolution so that the speed of shaft 46 varies correspondingly and this variation is stepped up further by the second stage of the mechanism, comprising members 56 and 68. Thus the output from shaft 70 has a cyclically varying speed compared to the input on shaft 34.

A gear 72 mounted on shaft 70 transmits this motion via the gear train 74-76-78 to drive the shaft carrying pulley 80 at an average speed of 1/27th machine speed, i.e. somewhat slower than the constant 1/24th machine speed of pulley 16. Thus, as the cigarettes move between the conveyor 4 and 6, they are progressively rotated about their axes until they have executed just over one complete revolution because of the relationship between the distance travelled through the device from one end of the perforator to the other, and the speed ratio of the conveyors. In the embodiment shown, the length of the perforator is 241.6 mm and the cigarettes are spaced at a pitch of 13.61 mm. With the speed ratio mentioned above, i.e. 8:9, the cigarettes are "rolled" a distance of (241.6/9)=26.85 mm which is just over one complete revolution for an average cigarette (25 mm circumference).

The rolling process is not, of course, continuous, because of the action of the speed modulator 30 whose input is a constant 1/6th machine speed and whose outputs varies over one complete speed variation cycle once for every revolution of the input. At the same time the perforator, which is reciprocated in synchronism with this variation, is caused to move downwards, by a mechanism to be described below, to perforate the cigarettes once for each speed variation cycle, at the point where its speed and direction of movement coincide with that of the conveyor 4. This is arranged to occur at the same instant as that at which the conveyor 6 reaches its maximum speed which must of course correspond to the constant speed of conveyor 4. Thus at the instant of perforation there is no relative motion between the cigarettes and the perforator, in the conveyor direction and the cigarettes are also not being rotated at that instant. The eccentricity adjustment of speed modulator 30 by means of the control knob 54 enables the maximum speed of conveyor 6 to be precisely controlled to ensure that it exactly matches the speed of conveyor 4.

Gear 26 driving the perforator to-and-fro (via crank 32) rotates at 1/6th machine speed, and the fluted conveyor drum 14 rotates at 1/24th machine speed and has 12 flutes and thus transfers three cigarettes into the perforator for each perforation cycle. Eighteen cigarettes are present in the perforator at any instant so it will be appreciated that each cigarette will be rotated and perforated in six stages. Thus by suitable spacing of the perforator pins and timing of the mechanism it is possible to arrange that the perforation is shared between a large number of pins.

Figure 4:
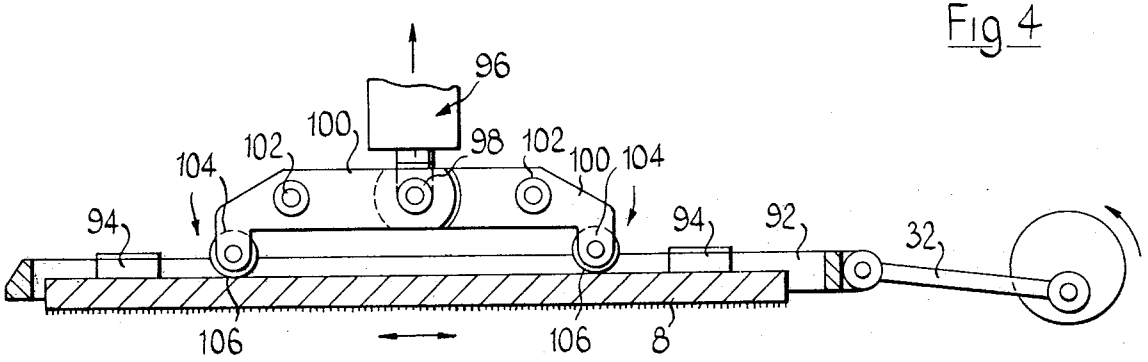
FIG. 4 is a side elevation of a further part of the apparatus.

FIG. 4 shows one possible arrangement for reciprocating the perforator in a direction perpendicular to conveyor 6, so as to perforate the cigarettes. The perforator 8 is mounted in a frame 92 which is driven by the crank arm 32 as shown in FIG. 1. This mechanism provides the reciprocation parallel to the conveyor, and for this purpose the frame 92 is preferably slidably mounted in tracks (not shown). The perforator 8 is connected to the sides of the frame 92 by leaf-springs 94, which are arranged to urge the perforator towards its upper position, i.e. away from the cigarettes on the conveyor.

A solenoid 96 is arranged to exert an upward pull at the required instant of perforation (under the control of a timing pulse generator connected to a suitable part of the mechanism). The solenoid is pivotally connected at 98 to the inner ends of two swing arms 100, each of which is pivoted about a fixed central point 102. The outer end 104 of each of the arms carries a roller 106 which bears against the upper surface of the perforator 8, so as to allow it to move to-and-fro under the influence of the drive provided by crank 32. As the inner ends of swing arms 100 are moved upwardly, the outer ends 104 thus move downwardly and transmit a suitable downward punching action to the perforator 8.

Figure 5:
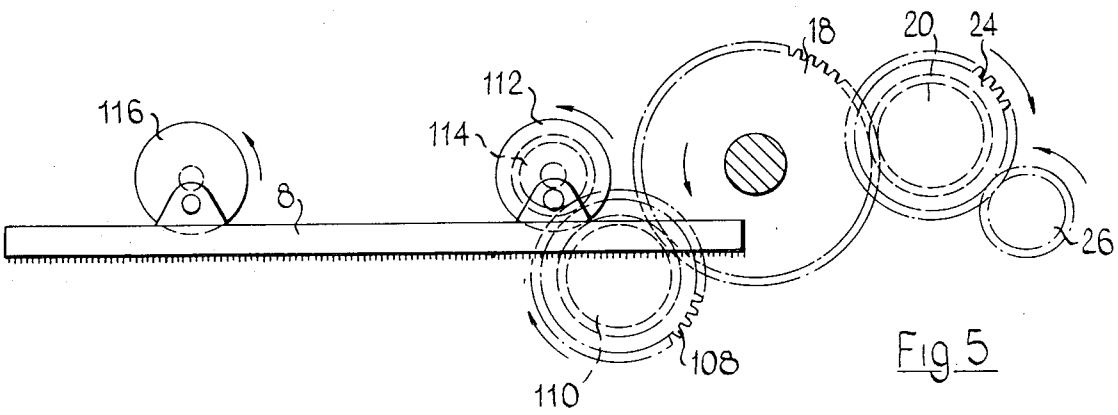
FIG. 5 is a side elevation of an alternative drive mechanism for part of the apparatus.

FIG. 5 shows an alternative drive mechanism for the perforator, which provides an approximation of the required to-and-fro and up and down movements with a single mechanism, which is capable of producing reasonably good quality perforations. In this arrangement, the drive is transmitted, as in the arrangement of FIG. 1, from shaft 22 via gear 20 to gear 18, to drive the pulley 16 of conveyor 4 at constant speed. The perforator 8 is driven from gear 18, via gears 108, 110 and 112, gear 112 being connected to a disc crank 114, to which one end of the perforator 8 is pivotally connected. The other end of the perforator is connected to another disc crank 116, which is, of course, carried round by the perforator in synchronism with disc crank 114. The gearing provided by the gear train 108-110-112 is such that the perforator contacts the cigarettes, so as to perforate them, each time the motion of conveyors 4 and 6 is synchronised, as explained above.

Figure 6:
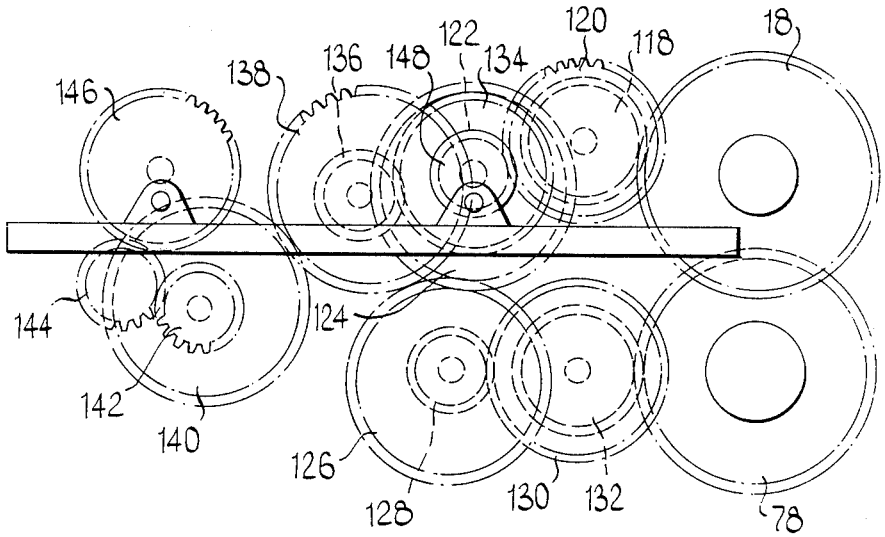
FIG. 6 is a side elevation of a further alternative mechanism.

It will be appreciated that the mechanism of FIG. 5 drives the perforator with a continuous rotary motion, whereas the cigarettes are arranged to be stationary at the instant of perforation, in order to avoid the practical problems encountered in perforators in which the cigarettes are rolled, as outlined above due to relative motion between the cigarettes and the perforator pins. A greatly improved synchronization between the motion of the perforator, and the motion of the cigarettes themselves, can be obtained if the perforator is driven by means of a speed modulating mechanism, so that its speed can be modulated in a similar way to that of the conveyor 6. FIG. 6 shows a drive mechanism which can provide speed modulation both for the conveyor 6, and for the perforator 8, and can thus replace both speed modulator 30, and the crank drive 32 of FIG. 1.

Figure 7:
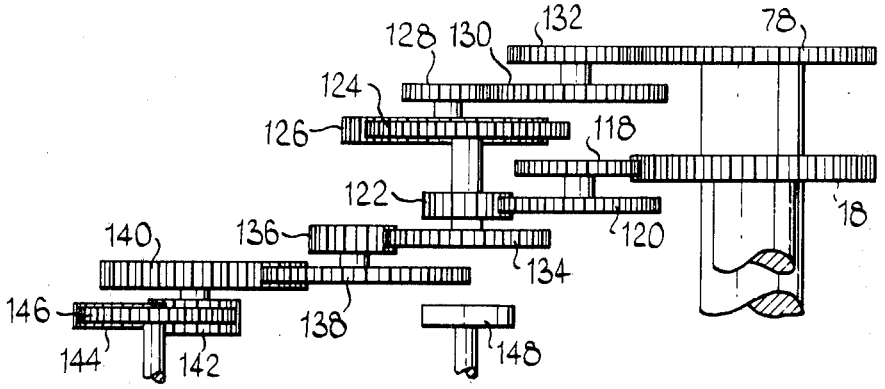
FIG. 7 is a plan view of the mechanism of FIG. 6.

Referring to FIG. 6, and also to FIG. 7 which shows a plan view of the gears of FIG. 6, the gear 18 is driven as before at 1/24th machine speed. A gear train 118-120-122 transmits this motion to a pair of meshing eccentrically mounted gears 124 and 126. The output of this pair of gears has the required speed modulated characteristic, determined by their eccentricity, and is transmitted to gear 78, driving pulley 80 (as in FIG. 1) by the gear train 128-130-132. The relationship between the size of gears 18 and 78 is the same as in FIG. 1, so that gear 78 rotates at an average 1/27th machine speed, when gear 18 is rotating at 1/24th machine speed.

A synchronised motion for the perforator 8 is derived in a similar fashion from the drive on gear 18, through the gear train 118-120-122-134-136, which transmits the motion to another pair of meshing eccentrically mounted gears 138 and 140. The eccentricity of these gears is similar to that of the pair 124, 126, and provides an output via gear train 142-144-146 for an eccentric drive to the perforator, through a crank pin 147 eccentrically mounted on gear 146. It will be appreciated, that as in the case of FIG. 5, only one end of the perforator is driven by the eccentric drive, connected to gear 146, whilst the other end of the perforator is connected to a disc crank 148 mounted on a freely rotating shaft.

Figure 8:
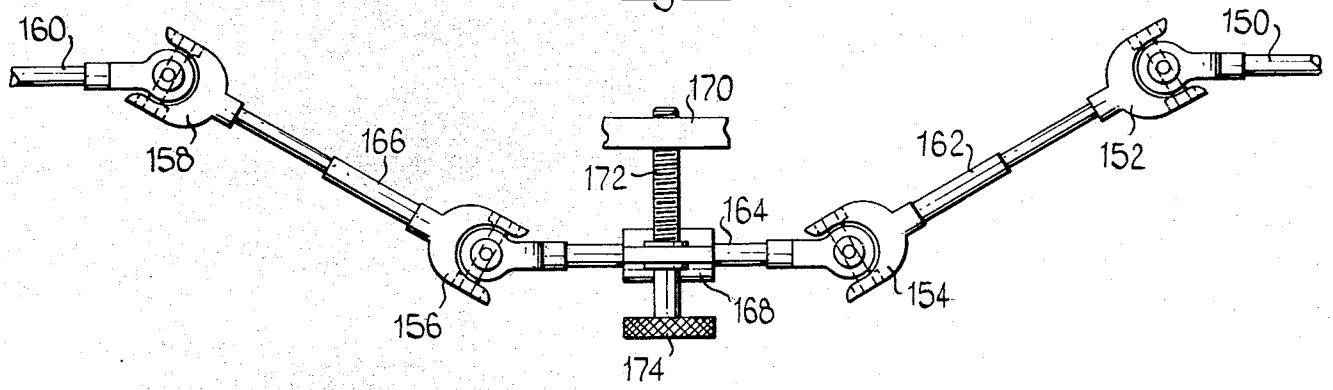
FIG. 8 is a schematic view of another alternative mechanism.

A further drive mechanism which can provide a modulated speed output is shown in FIG. 8. In this mechanism, the drive is supplied to an input shaft 150, and is transmitted via a series of four universal joints 152-154-156-158, to an output shaft 160. These are interconnected by a series of intermediate shafts 162, 164, 166, of which shafts 162 and 166 are telescopic, whilst shaft 164 is mounted parallel to the input and output shafts 150 and 160, but offset by an adjustable amount which determines the degree of speed modulation obtained from the mechanism. The central shaft 164 of the mechanism is journalled in a housing 168 which is connected to a fixed member 170 by means of screw threaded shaft 172. Rotation of a knurled wheel 174 on the end of a shaft thus moves the housing 168 relative to the fixed member 170 and thus alters the degree of speed modulation.

When the cigarettes have passed through the perforator they are carried off the conveyor 6 (FIG. 1) by the flutes 82 on the central part of the pulley 80 and travel in a clockwise direction supported by external guides 84 which co-operate with the filter portion of the double-length assembly, i.e. the central portion, so that any cigarettes with no filter are dropped to waste. The good assemblies are then transferred to another fluted conveyor 86 which carries them back to the drying drum 2.

Figure 11:
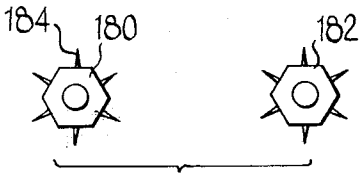
FIG. 11 is an end view of part of a further alternative form of perforator head.
Figure 10:
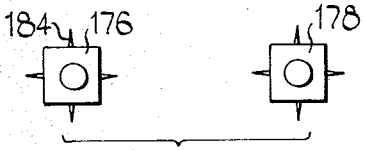
FIG. 10 is an end view of part of an alternative form of perforator head.
Figure 9:
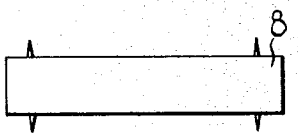
FIG. 9 is an end view of the perforator head of the device of FIG. 1.

The perforator head 8 of FIG. 1 comprises a flat bar-shaped device having a row of pins along each edge of each face, as shown in FIG. 9, so that the head can be inverted when the pins on one side are worn. This arrangement enables double-length filter cigarettes to be correctly perforated in the filter regions. If it is necessary to be able to vary the degree of perforation, this can be achieved by utilising an alternative form of perforator head as shown in FIG. 10 or 11. In these arrangements, instead of having a single elongate member carrying all the perforating pins, the head is divided longitudinally into two separate elongate prism-shaped members 176, 178 (FIG. 10) or 180, 182 (FIG. 11), which are arranged to be rotatable about their longitudinal axes. These heads may for example have four sides (FIG. 10) or six sides (FIG. 11) which carry either different numbers or different sizes of pins, so that the degree of perforation can be varied by rotating the heads. If the holes are to be in the region of 0.5–0.6 mm diameter, then the different sides of the head may carry pins 184 of various diameters to enable variation of cigarette dilution; if, however, the cigarettes are to be provided with a number of small holes, e.g. 0.25–0.3 mm in diameter, then the number of pins on each side of the perforator head may be different so that the total number of perforations made in each cigarette wrapper can be varied.

The rotational position of the perforator head may be varied during operation of the apparatus, if required in a number of ways: for example the end of the head may be provided with inclined cam-like faces and a suitably-shaped co-operating member or members may be retractably mounted in the path of the perforating head at one extreme of its reciprocating motion. Thus with one of the co-operating members at the "in" position, the head will engage it at the end of its stroke and will be rotated to the next rotational position, i.e. so as to produce more (or less) perforation. This can be arranged to occur automatically, for example by testing the resultant dilution of the perforated cigarettes and applying a feedback signal to the perforator indicative of whether the dilution should be (a) increased or (b) decreased, so that the head will be rotated suitably until correction dilution is achieved.

I claim:

1. A method of simultaneously perforating a plurality of rod-like articles such as cigarettes, comprising the steps of holding and transporting a group of articles in a row with their axes parallel between parallel flights of two conveyors; moving a perforating device towards the articles so as to perforate them over a first area, the perforating device extending in the plane of the conveyor flights and having a plurality of perforating needles on one face, retracting the perforating device, rotating all the articles of the group simultaneously through a preset angle by moving the two conveyors at different speeds so as to roll the articles between them, actuating the perforating device again, and repeating the process until the desired number of perforations have been provided in each article.

2. A method of perforating groups of rod-like articles as claimed in claim 1, in which the conveyors are moved continuously so as to enable a series of groups of articles to be fed through the perforator; and the perforating device is driven in such a way that it moves in synchronism with the conveyors whilst the articles are being perforated.

3. A method of perforating rod-like articles as claimed in claim 2 in which the articles are rotated between successive perforating operations by rolling them between the flights of the conveyors, the speed of one of the conveyors being arranged to vary cyclically so as to roll the articles in successive steps.

4. Apparatus for simultaneously perforating a group of rod-like articles, comprising a perforating station; two conveyors having parallel spaced flights arranged for holding and transporting articles through the perforating station; means for moving the conveyors alternately at the same speed and at different speeds whereby, when the conveyors move at different speeds they rotate the articles about their axes in successive steps during their movement through the perforating station; means for perforating mounted for movement towards the articles in the perforating station; and drive means arranged to actuate the conveyors and the perforating means in synchronism whereby the articles are rotated in successive steps between successive operations of the perforating means, so that each article will be perforated at a plurality of points around its circumference.

5. Apparatus as claimed in claim 4 in which the rotating means comprises drive means arranged to cyclically vary the speed of one of the two conveyors so that the articles are rolled in said successive steps.

6. Apparatus as claimed in claim 4 in which the drive means in arranged to drive a first of said two conveyors at a cyclically-varying speed and a second of said two conveyors at a constant speed; and said perforating means is reciprocated perpendicular to the run of the conveyors containing the articles so as to perforate them, and is also reciprocated parallel to the conveyors so as to follow the motion of the articles through the perforating station as they are being perforated.

7. Apparatus as claimed in claim 5 in which at least one of the conveyors comprises a pair of belts, the perforating means being positioned between the belts; whereby double-length cigarettes joined by a filter portion can be perforated in the filter portion.

8. Apparatus as claimed in claim 5 in which the average speed of the second conveyor is less than that of the other conveyor, whereby each article is rotated through a total of at least one revolution during its travel through the device.

9. Apparatus as claimed in claim 5 in which drive means for the conveyors includes a speed modulator comprising a rotatable input member driving an eccentrically-mounted rotatable intermediate member by means of a pin-and-slot connection, the intermediate member driving a rotatable output member which is coaxial with the input member, by means of a further pin-and-slot connection; whereby the degree of modulation is controlled by the eccentricity of the intermediate member.

10. Apparatus as claimed in claim 5 in which said perforating means is reciprocated parallel to the movement of the run of the conveyors by means of a crank drive.

11. Apparatus as claimed in claim 5 in which said perforating means is reciprocated perpendicular to the movement of the conveyors by means of an electromagnetic actuator.

12. Apparatus as claimed in claim 5 in which the drive for the conveyors and the parallel and perpendicular motion of the perforator are provided by means of a gear train including a pair of meshing eccentrically mounted gears, whereby the relative speed of the conveyors, and the motion of said perforating means, will be cyclically varied in synchronism.

13. Apparatus as claimed in claim 4 wherein said perforating device comprises an elongate body extending in the direction of the path of the articles with a plurality of perforating pins mounted on one face of the body and extending towards the articles.

14. Apparatus for simultaneously perforating a group of rod-like articles, comprising a perforating station, two conveyors having parallel spaced flights arranged for holding and transporting articles through the perforating station, a perforating device mounted for movement towards the articles in the perforating station and drive means arranged to actuate the conveyors and the perforating device in synchronism so as to cyclically vary the relative speeds of the two conveyors to roll the articles in successive steps between successive operations of the perforating means, the drive means including a speed modulator comprising an intermediate member rotatable by means of a pin-and-slot connection, the intermediate member driving a rotatable output member, which is coaxial with the input member, by means of a further pin-and-slot connection, whereby the degree of modulation is controlled by the eccentricity of the intermediate member.

15. A method of simultaneously perforating a plurality of rod-like articles such as cigarettes, comprising the steps of holding a group of articles in a row with their axes parallel between parallel spaced flights of first and second conveyors, moving the conveyors at different relative speeds during first non-adjacent time periods so as to roll the articles during the first time periods, moving the conveyors at substantially equal speeds during second time periods which exclude said first time periods, and moving a perforating device towards and then away from the articles so as to perforate them during said second time periods.

16. A method of perforating groups of rod-like articles according to claim 15 wherein the perforating device is driven in such a way that it moves in synchronism with the conveyors whilst the articles are being perforated.

17. A method of perforating rod-like articles according to claim 16 wherein the perforating means is reciprocated substantially perpendicularly to said parallel flights of the conveyors so as to perforate the articles, and is also reciprocated parallel to said parallel flights of the conveyors so as to follow the motion of the articles as they are being perforated.

18. A method of perforating groups of rod-like articles according to claim 15, 16 or 17 wherein the relative speeds of the conveyors are arranged to vary cyclically.

19. A method of simultaneously perforating a plurality of rod-like articles such as cigarettes, comprising the steps of conveying a group of articles through a perforating device perpendicular to the path of the articles so as to perforate them in successive steps, and reciprocating the perforating device parallel to the path of the articles so as to follow the motion of the articles during each perforating step, and rotating all the articles of the group simultaneously through a pre-set angle between successive perforating steps to present different areas to be perforated.

* * * * *